US007325549B2

(12) United States Patent
Dickens

(10) Patent No.: US 7,325,549 B2
(45) Date of Patent: Feb. 5, 2008

(54) HAIRDRESSING TOOL

(75) Inventor: Rachel P. Dickens, 10 Coronation Way, Cressing, Braintree, Essex (GB) CM77 8HY

(73) Assignee: Rachel P. Dickens, Braintree (GB)

( * ) Notice: Subject to any disclaimer, the term of this patent is extended or adjusted under 35 U.S.C. 154(b) by 402 days.

(21) Appl. No.: 10/840,029

(22) Filed: May 4, 2004

(65) Prior Publication Data

US 2005/0247325 A1 Nov. 10, 2005

(51) Int. Cl.
*A45D 24/04* (2006.01)
*A45D 24/16* (2006.01)

(52) U.S. Cl. ..... 132/120; 132/137

(58) Field of Classification Search ..... 132/120, 132/137, 138, 141, 142, 150, 152, 159, 107, 132/136, 219; 601/123, 125, 128, 135, 137, 601/138; 606/204
See application file for complete search history.

(56) References Cited

U.S. PATENT DOCUMENTS

| | | | | | |
|---|---|---|---|---|---|
| 731,575 | A * | 6/1903 | Johnston | 132/106 |
| 911,571 | A * | 2/1909 | Bradley | 132/129 |
| 1,563,944 | A * | 12/1925 | Allen | 601/137 |
| 1,700,064 | A * | 1/1929 | Lippincott | 132/148 |
| 2,598,330 | A * | 5/1952 | Wilson | 132/117 |
| 3,042,048 | A * | 7/1962 | Mostik | 132/149 |
| 3,545,434 | A * | 12/1970 | Woodruff | 601/137 |
| 3,797,506 | A * | 3/1974 | Reinsch | 132/137 |
| 3,831,592 | A * | 8/1974 | Lancellotti | 601/135 |
| 4,524,480 | A | 6/1985 | Bloom | |
| 5,375,287 | A | 12/1994 | Dillahunt | |
| 5,636,646 | A * | 6/1997 | Zito | 132/149 |
| 5,779,654 | A * | 7/1998 | Foley et al. | 601/137 |
| 6,241,694 | B1 * | 6/2001 | Goulding-Thompson et al. | 601/135 |
| 6,453,909 | B1 * | 9/2002 | De Laforcade | 132/208 |
| 6,789,549 | B2 * | 9/2004 | Johnson | 132/120 |
| 2006/0142678 | A1 * | 6/2006 | Hecht et al. | 601/135 |

* cited by examiner

*Primary Examiner*—Todd E. Manahan
(74) *Attorney, Agent, or Firm*—Seyfarth Shaw LLP

(57) ABSTRACT

A hairdressing tool has a handle 1 formed by a longitudinally extending arcuate portion 2 and a spine 3. Extending from the spine are three teeth 41, 42, 43 arranged in a triangular formation such that there is provided a tooth 41 at an apex of the triangle with teeth 42, 43 at the base of the triangle, the tooth 41 being arranged to be a leading tooth, in operation. A user's hair passes on each side of the leading tooth 41 and then between the trailing teeth 42, 43 so that a zig-zag parting is provided. Advantageously, the teeth have an enlarged dome-shaped portion remote from the confluence of the teeth with the spine. The handle 2, spine 3 and teeth 4 may be made of different materials although, preferably, the parts are integrally formed.

36 Claims, 1 Drawing Sheet

HAIRDRESSING TOOL

BACKGROUND OF THE INVENTION

1. Field of the Invention

This invention relates to a hairdressing tool.

2. Description of the Related Art

Conventional hairdressing tools such as combs and brushes are known.

Fine-tooth hair combs having a longitudinal spine and extending therefrom a single row of teeth are well known. However, known fine-tooth combs, which are preferred for smoothing hair to a desired extent, suffer from the disadvantages that they cannot readily be passed through the hair, particularly if the hair is tangled. It is, therefore, also well known to provide a comb with a single row of teeth in two portions, a second portion having teeth which are more finely spaced than the teeth in the first portion. Hair may then be first coarsely combed with the more coarsely spaced portion of the teeth and then more finely combed with the portion having more finely spaced teeth.

A hair comb having two rows of teeth is known from GB-539633-A in which a first row of teeth is coarsely spaced and a second row of teeth is finely spaced so that the first row of teeth coarsely combs the hair before the relatively finely spaced teeth comb the hair. The two rows of teeth are, preferably, formed with a convex curvature to provide a smoothing action on the hair. The teaching of the disclosure is of teeth of one of the rows being shorter than the teeth of the other row. This facilitates the use of the comb at an acute angle to the scalp. The disclosure of this publication is of tapering teeth. FR-A-900029 discloses a comb having a spine and plural teeth in a row which are spaced from one another, the teeth each having a cylindrical cross-section and being of the same length as one another.

It has become popular to comb hair to form a zig-zag parting of hair where the parting is either centrally located on a person's head, or on either side of the head. Such a zig-zag parting has the effect of achieving a greater volume of hair before styling by blow-drying.

Stylists generally achieve the zig-zag parting by holding a conventional comb at an angle to the scalp such that only the end is in contact with the scalp. The comb is then moved from front to back such that the end tooth describes a zig-zag at the base of the hairs, which are then separated by hand either side of the zig-zag parting. Using a conventional comb in this way is very difficult for the person who seeks to apply the zig-zag parting on their own hair.

SUMMARY OF THE INVENTION

It is an object of this invention to provide a hair comb which will enable a zig-zag parting to be more conveniently achieved both by a stylist and by a person seeking to apply the zig-zag parting to their own hair.

According to this invention there is provided a hairdressing tool including a spine and, extending from the spine, teeth arranged in a triangular formation whereby, in use, a leading tooth is located at the apex of the triangular formation and the other trailing teeth are located along the sides of the triangular formation such that as the tool is moved from front to back of a scalp in a zig-zag motion, the hair passes on each side of the leading tooth and then between the trailing teeth to separate the hairs and facilitate a zig-zag parting.

Preferably, only three teeth are provided, one at each corner of the triangular formation.

In an alternative embodiment, further teeth are provided along the sides of the triangular formation, whereby the pitch of the teeth determines the periodicity of the zig-zag. The larger the triangular formation the greater is the amplitude of the zig-zag.

Advantageously, the triangular formation of teeth is an isosceles triangular formation.

In a preferred embodiment, a tip of each tooth remote from the spine has an enlarged head for engaging a user's head.

Conveniently, said enlarged head is domed-shaped.

Preferably, the teeth along the base of the triangular formation are arranged substantially parallel to the longitudinal direction of the spine.

Conveniently, the teeth extend substantially orthogonally from the spine.

Advantageously, the teeth are made of metal.

Preferably, handle means is attached to the spine.

Conveniently, the handle means is integrally formed with the spine.

Advantageously, the handle means is arcuate for generally conforming to a user's hand.

Preferably, the teeth, spine and handle means are integrally formed with one another.

Advantageously, the teeth, spine and handle means are integrally formed from the same material.

Conveniently, the material is a plastics material.

In another embodiment, the handle means is made of wood, the spine is made of wood or metal or plastics, and the teeth are made of metal or plastics.

Advantageously, slider means are provided for altering the spacing between the teeth along the base of the triangular formation so as to alter the amplitude of the zig-zag.

Conveniently, the slider means is arranged so that the spacing is infinitely variable between defined opposed limits or variable in discrete steps between said defined opposed limits.

Preferably, the spine is demountable from the handle means and two or more spines are provided each having teeth arranged for a left or right-handed person.

Advantageously, the spine is mountable onto the handle means by a snap-fit fixing.

Conveniently, the spine is slidably mountable onto the handle means.

In an embodiment, a hair brush is attached to one end of a longitudinal handle means and the spine is attached at an opposite end thereof.

BRIEF DESCRIPTION OF THE DRAWINGS

The invention will now be described, by way of example, with reference to the accompanying drawings, in which.

In the Figures like reference numerals denote like parts.

DESCRIPTION OF THE PREFERRED EMBODIMENTS

Figure 1:
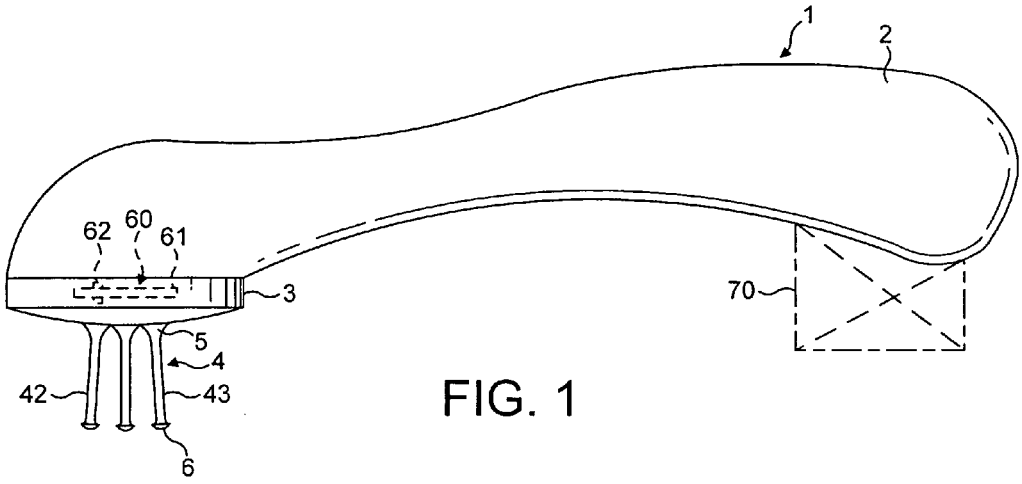
FIG. 1 shows a side view of a hairdressing tool in accordance with this invention.
Figure 2:
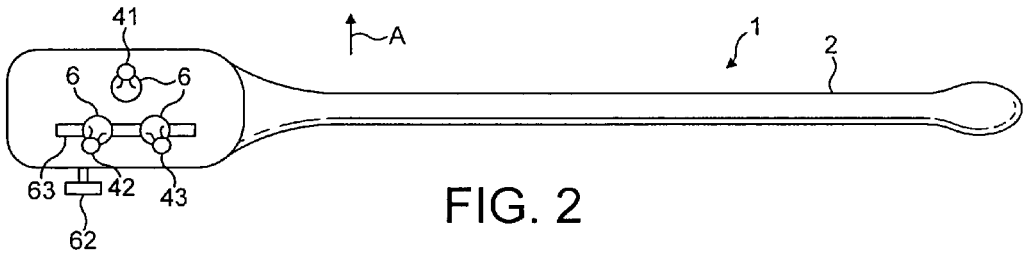
FIG. 2 shows an underside plan view of the tool shown in FIG. 1.
Figure 3:
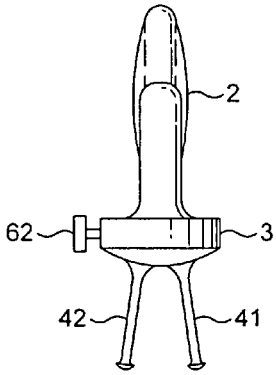
FIG. 3 shows an end view of the tool shown in FIG. 1.

Referring to the FIG. 1 to 3, a hairdressing tool has a handle 1 formed by a longitudinally extending arcuate portion 2 for being located in the palm of a hand of a user and the sides of the handle may be provided with a contoured finger grip portion (not shown). One end of the handle has a spine 3 for securing a triangular formation of teeth 4. As shown in the underside plan view of FIG. 2, the teeth 4 are arranged such that, when the comb is moved in a direction of arrow-headed line A, there is a tooth 41 at the apex of the triangle with trailing teeth 42, 43 at the corners of the triangular formation. The triangular formation is, preferably, an isosceles triangle, although an equilateral triangle may also be provided. At the confluence of each tooth with the spine the teeth may have an enlarged cross-sectional portion 5 for strength and, at a tip of each tooth at a remote end from the spine, there is provided an enlarged dome-shaped head 6 for comfort of a user when the teeth touch a user's head.

In an alternative embodiment, further teeth may be provided along the sides and base of the triangular formation and the pitch of the teeth determine the periodicity of the zig-zag, the size of the triangular formation determining the zig-zag amplitude. The number of teeth may also be varied in dependence upon differing hair textures.

The teeth along the base of the triangular formation are arranged substantially parallel to a longitudinal direction of the spine and, conveniently, the teeth extend outwardly from the spine and, preferably, substantially orthogonally from the spine.

The handle 2 may be a separate member from the spine 3 and attached to the spine by any convenient means, such as gluing, riveting, by means of screws or a snap-fit connection. However, in a further embodiment the handle 2 is integrally formed with the spine. Alternatively, the spine is slidably mounted on the handle.

It is to be understood that the tool shown is for a right-handed person, but a tool for a left-handed person may be formed by inverting the triangular formation.

Preferably, two or more spines are provided each having teeth arranged for a left or right-handed person.

The teeth may be separately formed from the spine but, in one preferred embodiment, the teeth, spine and handle are integrally formed with one another and are, preferably, formed from the same material, such as plastics.

In another embodiment, the handle is made of wood, the spine is made of wood or metal or plastics, and the teeth are made of metal or plastics.

In another embodiment, a slider 60 is provided for altering the spacing between the teeth 42, 43 along the base of the triangular formation so as to alter the amplitude of the zig-zag.

Conveniently, the slider 60 is arranged so that the spacing is infinitely variable between defined opposed limits or variable in discrete steps between said defined opposed limits.

In one embodiment, the slider 60 has a slot 61 within which is a, preferably, manually operable handle 62. The handle 62 is connected to a mechanism, for example a wheel and rack mechanism (not shown) for moving teeth 42, 43 with respect to one another. The teeth are connected to the mechanism and are movable within a slot 63.

Preferably, teeth 42 and 43 are both equi-movable apart from one another so as to retain their geometric relationship with tooth 41.

In use, the tool is drawn in a zig-zag line from front to back along a user's head through the base of the hairs in the direction of arrow-headed line A, so hair passes on each side of the leading tooth 41 and then between and around the trailing teeth 42, 43.

The tool has the advantage of ease of use for a stylist, and also for an individual seeking to apply a zig-zag parting to their own hair. Once the zig-zag parting has been established the hair may be moved by hand, brush and/or conventional comb to either side of the zig-zag parting.

In a further embodiment, a hair brush 70 is attached to one end of the longitudinal handle at the opposite end to the spine.

Although the present invention has been described with reference to preferred embodiments, workers skilled in the art will recognize that changes may be made in form and detail without departing from the spirit and scope of the invention.

The invention claimed is:

1. A hairdressing tool including a spine and elongate handle means, for locating in a palm of a hand of a user, the elongate handle means having a longitudinal axis, extending from the spine and, extending from the spine substantially orthogonally to the longitudinal axis, teeth arranged in a single triangular formation wherein a base of the triangular formation is substantially parallel to the longitudinal axis and a leading tooth is located at an apex of the triangular formation and at least two other trailing teeth are located along sides of the triangular formation such that as the tool is moved from front to back of a scalp in a zig-zag motion, the hair passes on each side of the leading tooth and then between the trailing teeth to separate the hairs and facilitate a zig-zag parting.

2. A tool as claimed in claim 1, wherein only three teeth are provided, one at each corner of the triangular formation.

3. A tool as claimed in claim 1, wherein the triangular formation of teeth is an isosceles triangular formation.

4. A tool as claimed in claim 1, wherein a tip of each tooth remote from the spine has an enlarged head for engaging a user's head.

5. A tool as claimed in claim 4, wherein said enlarged head is domed-shaped.

6. A tool as claimed in claim 1, wherein the teeth are made of metal.

7. A tool as claimed in claim 1, wherein the handle means is integrally formed with the spine.

8. A tool as claimed in claim 1, wherein the handle means is arcuate for generally conforming to a user's hand.

9. A tool as claimed in claim 1, wherein the teeth, spine and handle means are integrally formed with one another.

10. A tool as claimed in claim 1, wherein the teeth, spine and handle means are integrally formed from the same material.

11. A tool as claimed in claim 10, wherein the material is a plastics material.

12. A tool as claimed in claim 1, wherein the handle means is made of wood, the spine is made of wood or metal or plastics, and the teeth are made of metal or plastics.

13. A tool as claimed in claim 1, wherein slider means are provided for altering the spacing between the teeth along the base of the triangular formation so as to alter the amplitude of the zig-zag.

14. A tool as claimed in claim 13, wherein the slider means is arranged so that the spacing is infinitely variable between defined opposed limits or variable in discrete steps between said defined opposed limits.

15. A tool as claimed in claim 1, wherein the spine is demountable from the handle means and two or more spines are provided each having teeth arranged for a left or right-handed person.

16. A tool as claimed in claim 1, wherein the spine is mountable onto the handle means by a snap-fit fixing.

17. A tool as claimed in claim 1, wherein the spine is slidably mountable onto the handle means.

18. A tool as claimed in claim 1, wherein a hair brush is attached to one end of the elongate handle means and the spine is attached at an opposite end thereof.

19. A method of using a hairdressing tool having a spine and, extending from the spine, teeth arranged in a triangular formation, said method including moving a leading tooth located at an apex of the triangular formation and at least two other trailing teeth located along the sides of the triangular formation in a zig-zag motion from front to back of a scalp so that hair passes on each side of the leading tooth and then between the trailing teeth to separate the hairs and facilitate a zig-zag parting.

20. A method as claimed in claim 19, wherein only three teeth are provided, one at each corner of the triangular formation.

21. A method as claimed in claim 19, wherein the triangular formation of teeth is an isosceles triangular formation.

22. A method as claimed in claim 19, wherein a tip of each tooth remote from the spine has an enlarged head for engaging a user's head.

23. A method as claimed in claim 21, wherein said enlarged head is domed-shaped.

24. A method as claimed in claim 21, wherein the teeth are made of metal.

25. A method as claimed in claim 21, wherein the handle means is integrally formed with the spine.

26. A method as claimed in claim 21, wherein the handle means is arcuate for generally conforming to a user's hand.

27. A method as claimed in claim 21, wherein the teeth, spine and handle means are integrally formed with one another.

28. A method as claimed in claim 21, wherein the teeth, spine and handle means are integrally formed from the same material.

29. A method as claimed in claim 28, wherein the material is a plastics material.

30. A method as claimed in claim 21, wherein the handle means is made of wood, the spine is made of wood or metal or plastics, and the teeth are made of metal or plastics.

31. A method as claimed in claim 21, comprising altering a spacing between the teeth along the base of the triangular formation so as to alter the amplitude of the zig-zag.

32. A method as claimed in claim 31, comprising providing slider means arranged so that the spacing is infinitely variable between defined opposed limits or variable in discrete steps between said defined opposed limits.

33. A method as claimed in claim 21, wherein the spine is demountable from the handle means and two or more spines are provided each having teeth arranged for a left or right-handed person.

34. A method as claimed in claim 21, wherein the spine is mountable onto the handle means by a snap-fit fixing.

35. A method as claimed in claim 21, wherein the spine is slidably mountable onto the handle means.

36. A method as claimed in claim 21, wherein a hair brush is attached to one end of the elongate handle means and the spine is attached at an opposite end thereof.

* * * * *